US006204654B1

(12) United States Patent
Miranda et al.

(10) Patent No.: US 6,204,654 B1
(45) Date of Patent: Mar. 20, 2001

(54) DYNAMICALLY BOOSTED CURRENT SOURCE CIRCUIT

(75) Inventors: Evaldo M. Miranda; Jonathan M. Audy, both of San Jose; David Thomson, Fremont, all of CA (US)

(73) Assignee: Analog Devices, Inc., Norwood, MA (US)

( * ) Notice: Subject to any disclaimer, the term of this patent is extended or adjusted under 35 U.S.C. 154(b) by 0 days.

(21) Appl. No.: 09/240,648

(22) Filed: Jan. 29, 1999

(51) Int. Cl.[7] ..... G05F 3/16
(52) U.S. Cl. ..... 323/316; 323/299
(58) Field of Search ..... 323/265, 274, 323/299, 312, 315, 316

(56) References Cited

U.S. PATENT DOCUMENTS

Re. 30,948 * 5/1982 Schade ..... 330/288
4,539,493 * 9/1985 Varadarajan ..... 307/455
5,473,270 * 12/1995 Denker ..... 326/95
5,510,754 * 4/1996 Moraveji et al. ..... 330/267
5,675,270 * 10/1997 Huang ..... 327/108

* cited by examiner

*Primary Examiner*—Jeffrey Sterrett
(74) *Attorney, Agent, or Firm*—Koppel & Jacobs

(57) ABSTRACT

A dynamically boosted current source circuit improves the response speed of a circuit responsive to a transitioning input signal. The circuit's responsiveness varies with the magnitude of the current provided to an identified node, and a current source capable of providing nominal and boosted currents is connected to the node. A threshold detector detects the occurrence of an input signal transition prior to its detection by the responsive circuit, and triggers the current source to provide the boosted current; this improves the responsive circuit's speed by charging or discharging identified node capacitances which hinder its operation. The identified node can be an input node, an output node, or an internal node. The current source provides the boosted current for a predetermined time interval, or until the input signal crosses a second threshold, enabling response speed to be increased without a significant increase in supply current.

44 Claims, 7 Drawing Sheets

DYNAMICALLY BOOSTED CURRENT SOURCE CIRCUIT

BACKGROUND OF THE INVENTION

1. Field of the Invention

This invention relates to the field of current sources, and particularly to current source circuits and methods used to charge capacitive nodes.

2. Description of the Related Art

There is some amount of capacitance associated with every node in an electronic circuit. The capacitance may take the form of, for example, a discrete circuit element, a capacitive load, or a parasitic capacitance. Regardless of its form, a circuit node's capacitance affects the speed with which a signal connected to it can transition from one state to another, because the node's capacitance must be charged (if the node's voltage is to increase) or discharged (if the voltage is decreasing) before the transition can occur. This capacitance-induced time lag may be unacceptably long, adversely affecting the performance of circuitry which is ideally fast-responding.

Various techniques are employed to charge and/or discharge node capacitance. An example is illustrated in FIG. 1. A transmitter device 10 sends a signal 12 to a receiver device 14. A transmitter and a receiver often operate with different supply voltages. In such cases, a signal sent from transmitter to receiver is typically generated with an open drain or open collector transistor such as open-drain NMOS FET 16, and then referenced to the receiver's supply voltage with a pull-up device 18 in the receiver.

As noted above, a capacitance is associated with every circuit node. In FIG. 1, a parasitic capacitance $C_{par}$ is found at the junction of FET 16 and pull-up device 18. Transistor 16 can pull down signal 12 very rapidly, but when transistor 16 is off (indicating a "high" output), pull-up device 18 pulls up signal 12. However, before signal 12 can rise, $C_{par}$ must be charged, and the time required to do this slows a low-to-high transition of signal 12. For example, assume signal 12 is to transition from 0 to 3 volts ($\Delta V=3$ volts), pull-up device 18 provides 120 $\mu$A ($i_{pullup}$), and $C_{par}$ is 10 pf. The transition time $\Delta t$ is given by:

$$\Delta t = C_{par} * (\Delta V / i_{pullup}) = 250 \text{ ns}$$

Once received by receiver 14, signal 12 is typically fed to a circuit 19 which detects a transition of signal 12. However, if transition time $\Delta t$ is too long, the response speed of detection circuit 19 can be slowed such that it cannot meet its performance requirements.

Pull-up device 18 is conventionally a resistor or a fixed current source. A resistive pull-up can result in a low-to-high transition that is unacceptably slow, because the current charging $C_{par}$ will decrease as the signal 12 voltage increases. A fixed current source avoids this problem, but also has a major drawback in low power applications: in circuits where low power consumption is important, idle current—i.e., the current consumed when the circuit's inputs are not changing—is preferably low. A fixed current source, however, wastes power by continuously providing current as signal 12 transitions from high to low, and while signal 12 is in its low state.

Another common capacitive node situation is shown in FIG. 2. An operational amplifier 20 is driving a capacitive load $C_{load}$ at a node 22. A typical op amp includes an input stage 24 and an output stage 26. The input and output stages are biased from a fixed current source 28. If op amp 20 is suddenly required to increase its output voltage, the capacitance at node 22 must be charged, typically at a specified speed. The current to charge $C_{load}$ comes from the output stage. However, the ability of the output stage to drive a load is limited by the fixed amount of bias current available from current source 28 to drive the output stage transistors. While a large current source 28 would reduce the transition time, the size of the current source is often limited to minimize the consumption of supply current. Limiting the bias current, however, also acts to limit the speed with which node 22 can be charged or discharged and the output voltage changed.

SUMMARY OF THE INVENTION

A dynamically boosted current source circuit and method are presented which overcome the problems noted above. The circuit and method improve the speed with which capacitive nodes can be charged or discharged without unduly increasing supply current demands, thereby improving the responsiveness of the circuits in which the capacitive nodes reside.

The present invention is useful in circuits which respond to a transitioning input signal, when an increase in the circuit's response speed is necessary or desirable. The circuit is such that its responsiveness varies in proportion to the amount of current delivered to an identified node; for example, the circuit may receive a bias current that allows it to respond to an input up to a maximum speed. A current source is connected to provide a bias current to the circuit, and a threshold detector is used to detect the occurrence of an input signal transition. The threshold detector's output is connected to the current source, which has at least two operating states. When no input signal transition has been detected, the current source is in a first state delivering a first bias current to the circuit. However, when the detector indicates the occurrence of a transition, the current source is triggered into its second state and provides a boosted bias current to the circuit. The boosted bias current is greater than the first bias current and, while present, improves the circuit's responsiveness by speeding the charging (or discharging) of capacitance present at the identified node, at another node driven by circuitry that includes the identified node, or both. Because bias current to the node is boosted in response to an external event (the transitioning of an input signal), the invention is referred to as a "dynamically boosted current source circuit".

The identified node can be an input node—including the node which receives the transitioning input signal, an output node, an internal node, or any combination of these. The current source is arranged to provide the boosted current for a predetermined time interval (after which it returns to its first state), or until the input signal crosses a second threshold. In either case, the boosted current is only provided temporarily, in response to an input signal transition. As a result, response speed can be increased without a significant increase in supply current.

Further features and advantages of the invention will be apparent to those skilled in the art from the following detailed description, taken together with the accompanying drawings.

DETAILED DESCRIPTION OF THE INVENTION

Figure 3:
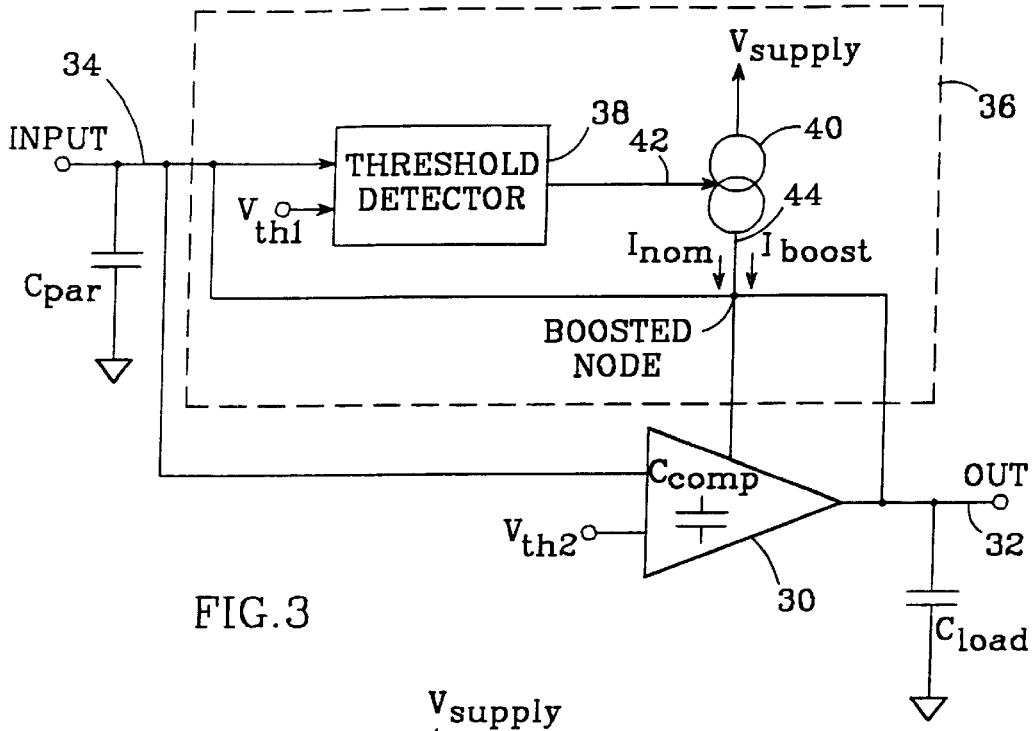
FIG. 3 is a block/schematic diagram illustrating the basic principles of the present invention.

The basic principles of the invention are illustrated in FIG. 3. A circuit 30 produces an output OUT at a node 32. The circuit changes state—typically by changing its output—in response to the transitioning of an input signal INPUT presented at an input node 34; i.e., circuit 30 responds in some fashion when INPUT changes state. The speed with which circuit 30 responds (the circuit's "responsiveness" or "response speed") to the transitioning input can be slowed by the presence of one or more capacitive load nodes found, for example, at input node 34, internal to circuit 30, external to circuit 30, or all of the above—which must be charged or discharged before the response can be completed. For example, a parasitic capacitance $C_{par}$ may be present at node 34, a capacitive load $C_{load}$ may be connected to node 32, and/or a capacitive compensation network $C_{comp}$ may be present within circuit 30.

At least one dynamically boosted current source circuit 36 is used to improve the responsiveness of circuit 30 to a change in the state of an input signal presented at node 34. Circuit 36 includes a threshold detector circuit 38 which is connected between input node 34 and a current source circuit 40. Threshold detector 38 is arranged to detect a change of state at input node 34. The change of state detected can be, for example, input signal INPUT crossing a threshold voltage $V_{th1}$ which is provided to the detector (as shown in FIG. 3), or the occurrence of an input signal transition (discussed in relation to FIG. 8, below); the particular condition detected is application-specific.

The threshold detector produces an output 42 that indicates when an input signal transition has been detected. The current source circuit 40 is arranged to receive and respond to output 42. Current source 40 has at least two operating states. The current source 40 operates in a first state when no transition has been detected; in this state, the current source provides a first, nominal current $I_{nom}$ at an output 44. However, when an input signal transition has been detected as indicated by output 42, current source 40 is triggered into a second operating state in which it provides a second, boosted current $I^{boost}$ at output 44, with $I_{boost}$ being greater than $I_{nom}$ Output 44 of current source circuit 40 is connected to one or more of the capacitive load nodes responsible for slowing the responsiveness of circuit 30. For example, output 44 can be connected to input node 34, to output node 32, and/or to an internal node of circuit 30, to speed the charging (or discharging) of $C_{par}$, $C_{load}$, or $C_{comp}$, respectively. If desired, output 44 can be used to generate currents for all three nodes, or individual dynamically boosted current source circuits could be used for respective nodes.

The invention contemplates using dynamically boosted current source circuits for both charging and discharging a capacitive node, since either of these operations may be necessary to improve responsiveness. For example, if output node 32 is to swing from zero volts to a positive voltage in response to a change of state at input node 34, $C_{load}$ must be charged before OUT can reach its final voltage. On the other hand, if output node 32 is to fall from a positive voltage toward zero volts, $C_{load}$ must be discharged before OUT can reach its final voltage. Thus, current source 40 can be connected to supply current to a node to charge a capacitance (as shown in FIG. 3), or alternatively, to draw current from a node to discharge a capacitance.

The dynamically boosted current source circuit is arranged to provide the boosted current $I_{boost}$, for a particular duration. The duration can be strictly threshold-dependent, with the current increased to $I_{boost}$ when the voltage at input node 34 crosses $V_{th1}$ and returning to $I_{nom}$ when INPUT crosses a predetermined higher threshold or reaches a level at which circuit conditions force current source circuit 40 to reduce the output current. Alternatively, a predetermined time interval $T_d$ can be defined, with the current increasing to $I_{boost}$ when INPUT crosses a predetermined threshold, and returning to $I_{nom}$ after time $T_d$.

Circuit 30 can be, for example, an operational amplifier, which receives one or more bias currents—the magnitude of which limit the amplifier's response speed. To increase the amplifier's response speed, current source 40 boosts the bias currents in response to a transition in the state of INPUT (discussed in detail below). Circuit 30 can also be, for example, a logic gate or a comparator, which changes state when INPUT crosses a threshold voltage $V_{th2}$. $V_{th1}$ can be made equal to or greater than $V_{th2}$, such that a current boost occurs only when INPUT has reached or exceeded the input threshold voltage of circuit 30. Preferably, however, $V_{th1}$ is made to be less than $V_{th2}$, so that a current boost occurs before INPUT reaches $V_{th2}$ and thereby begins speeding the responsiveness of circuit 30 in anticipation of INPUT exceeding $V_{th2}$.

Figure 4:
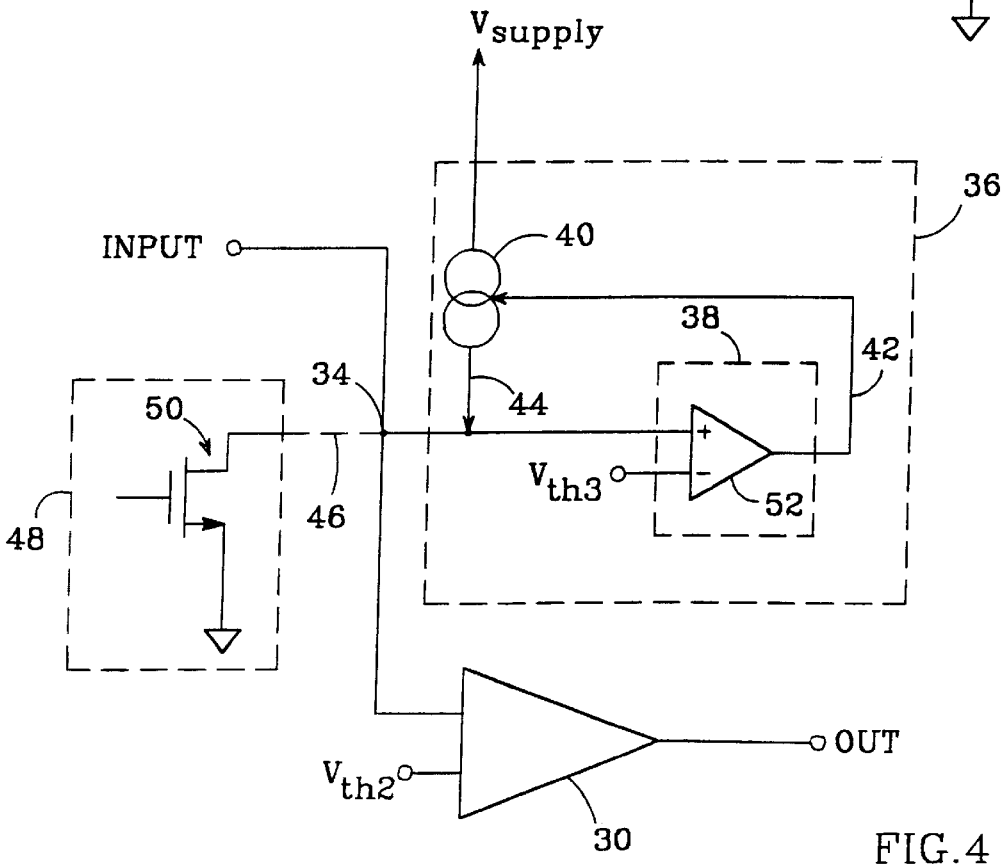
FIG. 4 is a block/schematic diagram of one embodiment of the present invention.

One possible embodiment of the present invention is shown in FIG. 4. Dynamically boosted current source circuit 36 serves as a receiver circuit for a signal 46 received from a transmitting circuit 48. Signal 46 originates at the open drain (or equivalently, an open collector) of an NMOS transistor 50. Transistor 50 can quickly pull down signal 46 when it is to transition from high to low. However, transistor 50 is turned off when signal 46 is to transition from low to high, necessitating the use of a pull-up device.

Current source 40 is connected to input node 34, and provides the necessary pull-up for signal 46. (Alternatively, current source 40 can serve as a pull-down device if transistor 50 is of the opposite polarity to that shown; in this case, current source 40 would be connected between node 34 and ground or a negative supply voltage). By providing $I_{boost}$ to node 34 upon detection of a low-to-high transition, the parasitic capacitance associated with node 34 is quickly charged so that signal 46 is pulled up quickly—improving the response speed of any circuit, such as circuit 30, that is responsive to a signal 46 transition.

In this exemplary embodiment, threshold detector 38 is implemented with a comparator 52 which receives a threshold voltage $V_{th3}$; $V_{th3}$ can be derived from, for example, the $V_{be}$ of a diode, a bandgap voltage reference, the thermal voltage $V_t$, or the voltage drop across a resistor connected to a current source. Output 42 is toggled high when the voltage at input node 34 exceeds $V_{th3}$. (Comparator 52 could also be configured to toggle output 42 low when input node 34 exceeds $V_{th3}$, if necessary to trigger current source circuit 40 into its boosted state). The positive feedback loop formed by comparator 52 and current source 40 enable signal 46 to be quickly stewed toward a predetermined maximum value.

Figure 5:
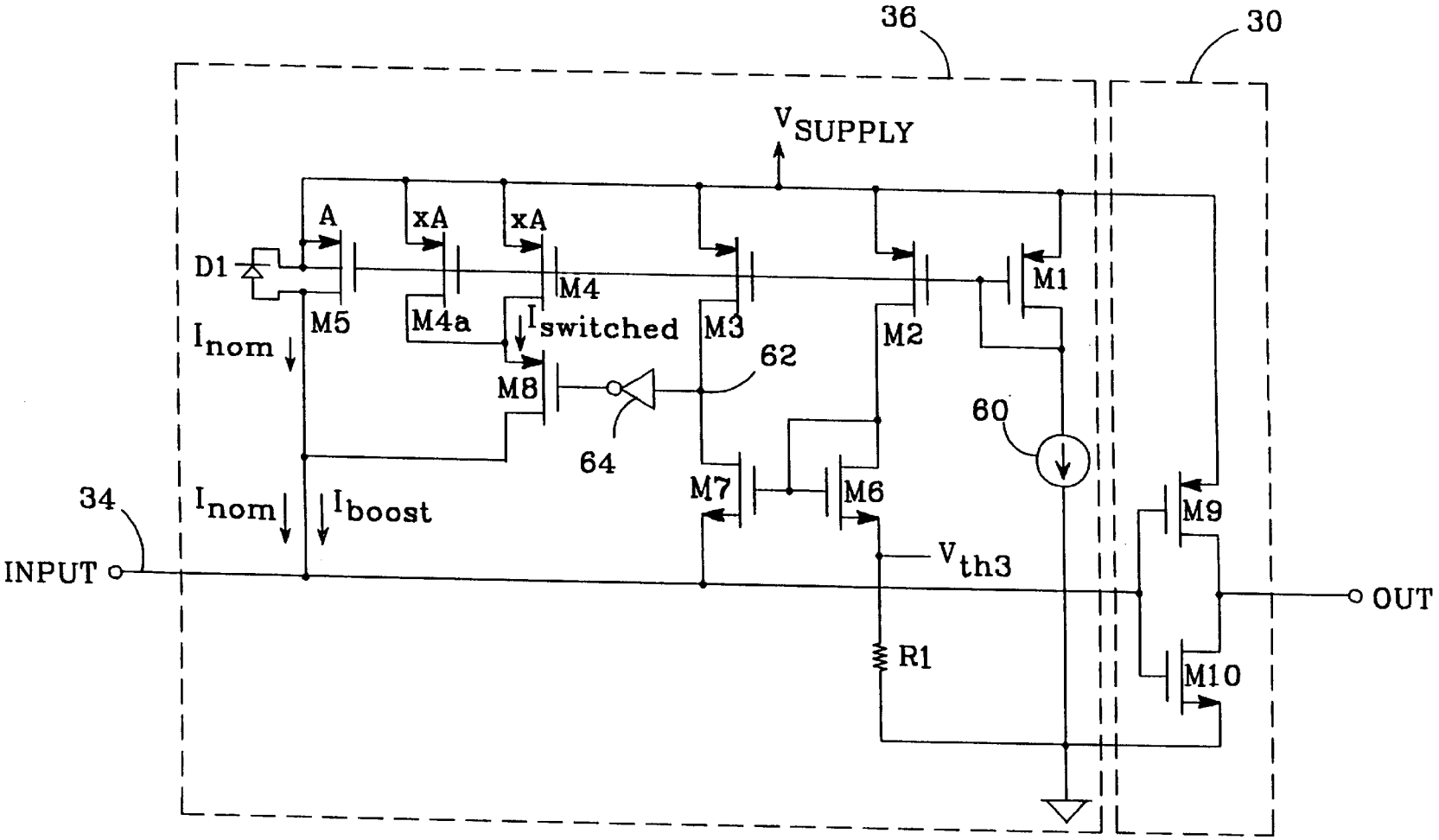
FIG. 5 is a schematic diagram of the embodiment shown in FIG. 4.

FIG. 5 is a schematic diagram of one possible implementation of the circuit shown in FIG. 4. A bias current is provided by a current source 60, which is mirrored by diode-connected transistor M1 to transistors M2, M3, M4 and M5; the sources of each of M1–M5 are connected to a supply voltage $V_{supply}$. The current mirrored by M2 is fed to a resistor R1 (via a diode-connected transistor M6), with the voltage developed across R1 providing the reference voltage $V_{th3}$ for comparator 52. Transistor M5 is connected to mirror the M1 current to input node 34; M5's current is identified as $I_{nom}$, as it provides a nominal pull-up current to input node 34.

Mirror transistor M3 is connected to provide current to a transistor M7, which has its source connected to input node 34. M6 and M7 form the core of comparator 50, with their drains connected to mirror transistors M2 and M3, respectively, and their sources connected to input node 34 and reference voltage $V_{th3}$, respectively. As the voltage at input node 34 rises above $V_{th3}$, transistor M7 is turned off; conversely, M7 is turned on when INPUT falls below $V_{th3}$. The junction (62) between M3 and M7 is fed to an inverter 64, which in turn drives a transistor M8 connected as a switch between mirror transistor M4 and input node 34. When M7 is turned on, node 62 is pulled down and inverter 64 outputs a "high" to turn M8 off and prevent M4's current from being provided to input node 34. Conversely, when M7 is turned off, M3 pulls up node 62, inverter 64 outputs a "low", M8 is turned on, and M4's current is provided to input node The state of M8 determines the operating state of current source circuit 40 (shown in FIG. 4), which in this implementation includes mirror transistors M1, M4 and M5, switching transistor M8, and bias current source 60. Mirror transistor M4 is connected to provide a current $I_{switched}$ to input node 34 when M8 is switched on, and transistor M5 provides current $I_{nom}$ to input node 34. When M8 is off, indicating that INPUT is less than $V_{th3}$, the current source circuit is in its first operating state, providing just nominal current $I_{nom}$ to input node 34. However, when M8 is switched on, indicating that INPUT is greater than $V_{th3}$, the current source circuit is triggered into its second operating state, and both $I_{nom}$ and $I_{switched}$ are provided to input node 34. That is, when M8 is on, $I_{nom}$ and $I_{switched}$ are summed together to create a boosted current $I_{boots}$, which is delivered to input node 34.

Responsive circuit 30 is shown as an inverter circuit in FIG. 5. The inverter is made from a pair of opposite-polarity transistors M9 and M10 that are series connected between $V_{supply}$ and ground; the junction between the their respective drains provides the inverter's output OUT. The gates of M9 and M10 are connected to input node 34, such that the inverter's output OUT is responsive to the state of the signal connected to input node 34.

The inverter has an associated voltage threshold $V_{th2}$. When compared with $I_{nom}$ alone, boosted current $I_{boost}$ reduces the time required to charge the capacitance associated with input node 34. Provided that $V_{th3}$ is less than $V_{th2}$, delivering $I_{boost}$ to input node 34 upon a change in the state of INPUT causes the node capacitance to be quickly charged; and for OUT to toggle faster than it would without the assistance of $I_{boost}$. Thus, the response speed of circuit 30 is increased.

One way in which the amount of boosted current provided by dynamically boosted current source circuit 36 can be varied is by adjusting the size of transistor M4. For example, if $I_{switched}$ is to be equal to $I_{nom}$, the drain areas of M4 and M5 (labeled "A" and "xA", respectively, in FIG. 5, where "x" is a factor by which A is multiplied) should be made equal; i.e., with x=1. $I_{switched}$ can be made greater than $I_{nom}$ by making x greater than 1, or smaller than $I_{nom}$ if x is between 0 and 1. Alternatively, the boosted current can be provided by two or more transistors connected in parallel; each transistor can be sized as needed to provide any desired integer and/or fractional multiple of A. For example, as shown in FIG. 5, a second transistor M4*a* could be connected in parallel with M4; if the x values for M4 and M4*a* are equal to 1 and 0.5, respectively, a boosted current equal to 1.5 A will be provided to node 34 when M8 is switched on. The amount of boost current to provide is dependent on factors such as desired response speed and acceptable current consumption. Though current consumption is only increased when a signal at input node 34 changes state, the dynamically boosted current source circuit does increase total current consumption when compared to a fixed current source supplying only $I_{nom}$ to the input node.

Many other circuits and/or techniques could be employed to provide boosted current $I_{boost}$. In the circuit configuration shown in FIG. 5, for example, the current provided to node 34 could be boosted by increasing the current produced by current source 60 upon detection of an input signal transition.

It should be noted PMOS devices, such as M1–M5 and M8–M9 in FIG. 5, typically have a parasitic diode between their drain and body terminals; this is exemplified by the diode D1 shown connected across M5. In normal operation, M5's source is at a higher potential than its drain, and Dl is reverse-biased. However, if the drain voltage rises above the source—if, for example, the power to the receiving circuit 36 is turned off but is still applied to the transmitting circuit 48 (shown in FIG. 4)—D1 becomes forward-biased and draws current away from the transmitter unnecessarily. This can be avoided by employing "body switching" circuitry, which switches the body terminal of PMOS transistor M5 to the terminal (drain or source) at the highest potential, insuring that parasitic diode D1 is always reverse-biased.

Figure 1:
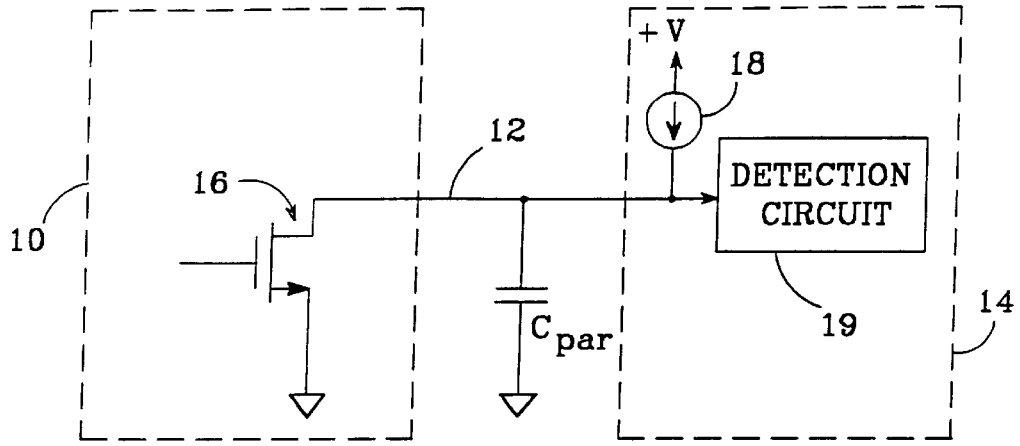
FIG.1 (Prior Art)
FIG. 1 is a schematic of known transmitter and receiver devices using a conventional pull-up device.
Figure 2:
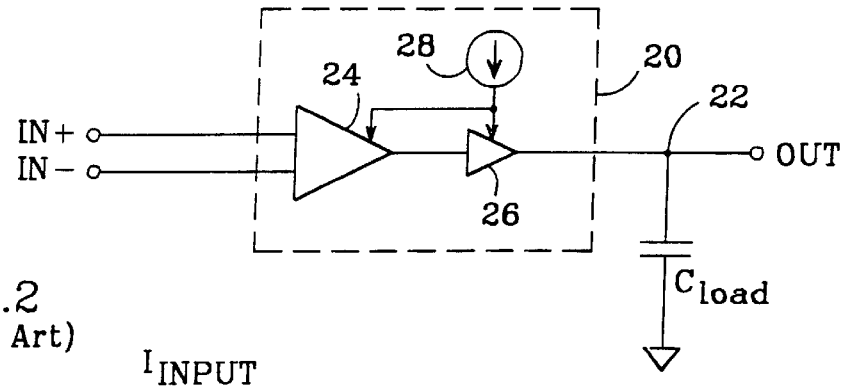
FIG.2 (Prior Art)
FIG. 2 is a schematic of a known operational amplifier using a conventional current source to provide a bias current.
Figure 6:
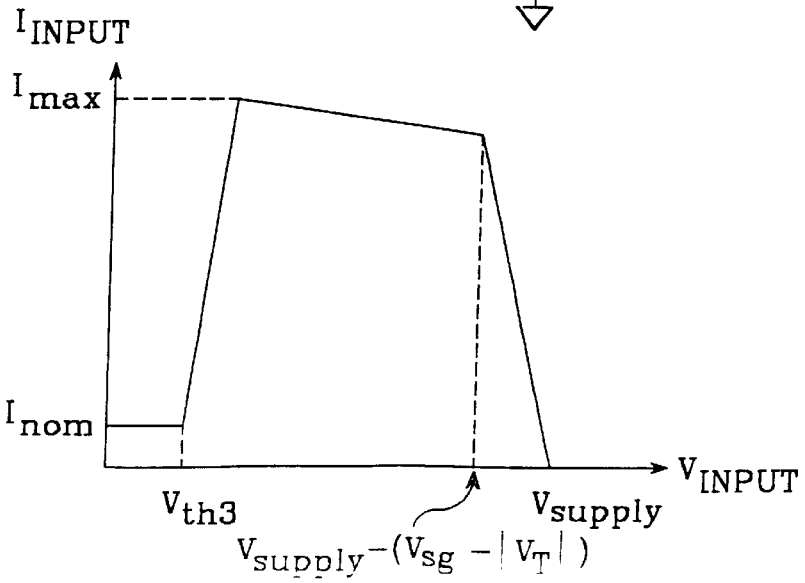
FIG. 6 is a plot of the current provided to a node vs. the node voltage for the embodiment shown in FIG. 4.

A plot of the pull-up current ($I_{INPUT}$) delivered to input node 34 with respect to the node's voltage ($V_{INPUT}$) for the circuit of FIG. 5 is shown in FIG. 6. When $V_{INPUT}$ is below $V_{th3}$, the current provided to input node 34 is simply the nominal current $I_{nom}$ from M5. As $V_{INPUT}$ rises and crosses $V_{th3}$, $I_{switched}$ is added to $I_{nom}$ and the current is boosted to a value labeled as $I_{max}$ in FIG. 6. $I_{INPUT}$ remains near $I_{max}$ (decreasing slowly due to channel length modulation) as long as the voltage across M4 ($V_{ds}$) is greater than M4's source-to-gate voltage ($V_{sg}$) minus its threshold voltage ($V_T$). When $V_{ds}$ becomes equal to or less than $V_{sg-VT}$, M4 enters its triode region and the current supplied to input node 34 decreases quickly.

Simulated comparisons have been performed between a fixed current source pull-up and the dynamically boosted current source circuit pull-up shown in FIG. 5. For a 20 $\mu$A fixed pull-up current source, input node 34 was seen to slew from low-to-high in about 600 nsec. Using the circuit of FIG. 5 to provide an $I_{max}$ value of 135 $\mu$A (and with a 10 pf capacitor connected between node 34 and ground) reduced the slewing time to less than 200 nsec.

Figure 7:
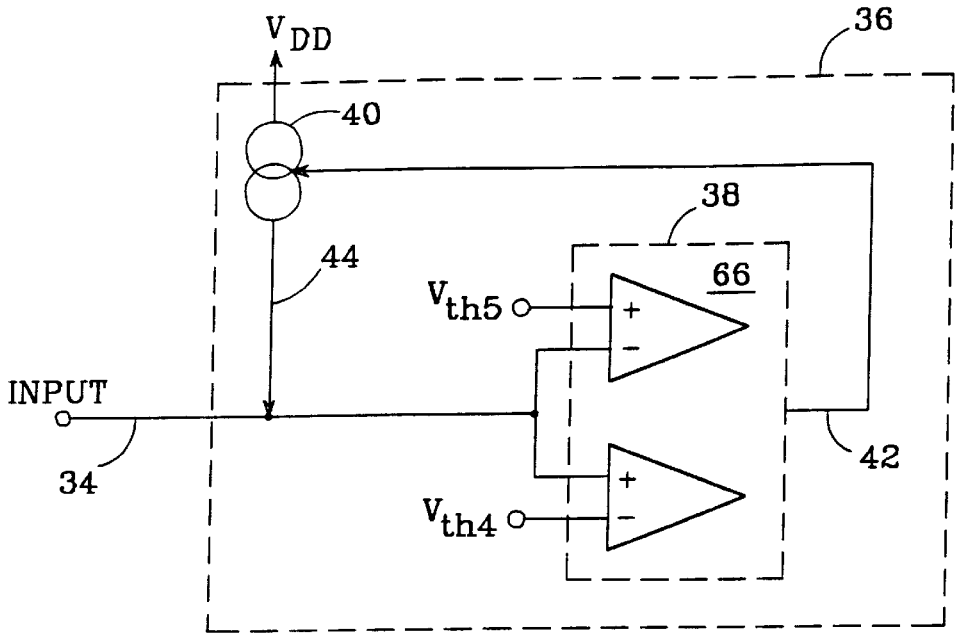
FIG. 7 is a block/schematic diagram of an alternative embodiment of the circuit shown in FIG. 4.

An alternative embodiment of the dynamically boosted current source circuit 36 of FIG. 4 is shown in FIG. 7. Threshold detector 38 is implemented with a window comparator 66 instead of single comparator 50 as in FIGS. 4 and 5. Window comparator 66 receives low and high threshold voltages $V_{th4}$ and $V_{th5}$, respectively; output 42 is toggled when a signal applied to input node 34 is between $V_{th4}$ and $V_{th5}$. This technique provides more precise control over the point at which the boosted current is reduced, but this may be offset by the more complex circuitry needed to achieve the improvement.

Note that the circuit implementations shown in FIGS. 4, 5 and 7 are merely illustrative. A number of different threshold detection and current source circuits could be utilized for threshold detector 38 and current source 40; numerous comparator, transition detector, and current source designs are known to those skilled in the art of analog circuit design. Though depicted as implemented with field-effect transistors (FETs), the invention is in no way limited to the use of FETs. For example, bipolar transistors could be substituted for M1–M10 without affecting the basic operation of the circuit (though the formula for the point at which $I_{INPUT}$ falls in the plot of FIG. 6 would change).

As is apparent to those skilled in the art, when an input signal connected to input node 34 transitions from high to low, it is not necessary to boost the current to node 34 of the circuit shown in FIG. 4. During a high-to-low transition, transistor 50 in transmitting circuit 48 is turned on and pulls down node 34. Boosting the current to node 34 during a high-to-low transition may adversely affect how quickly transistor 50 can be turned on. An application of the invention in which it is beneficial to provide a boosted current for both low-to-high and high-to-low transitions of an input signal is discussed below.

Figure 8:
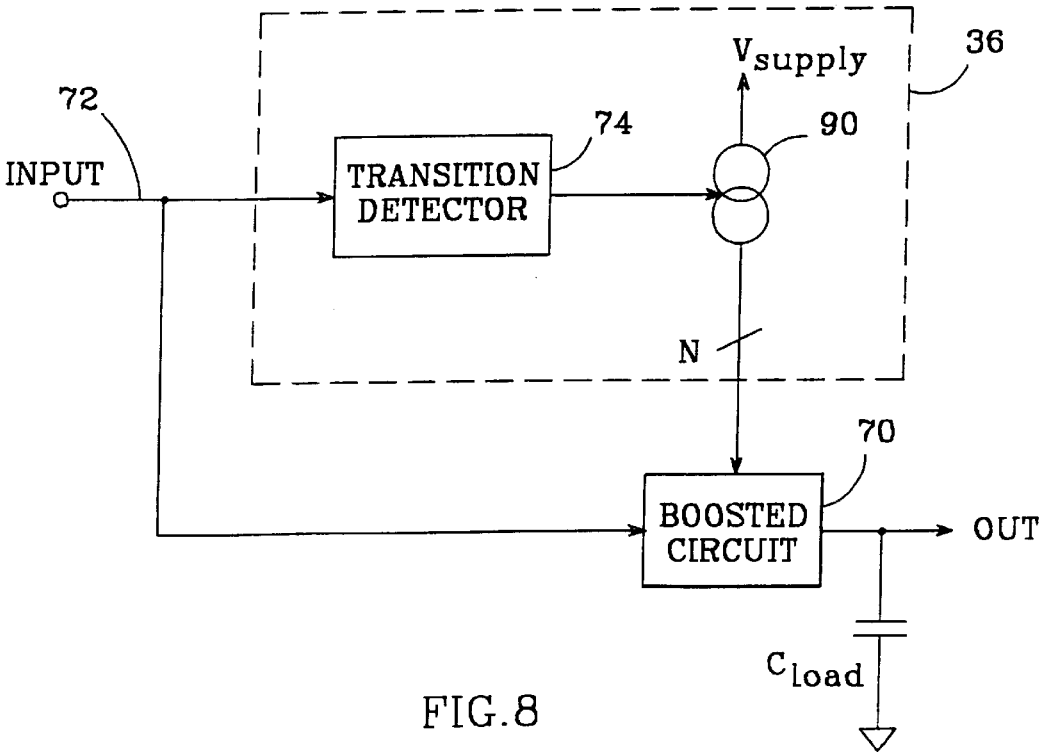
FIG. 8 is a block/schematic diagram of another embodiment of the present invention.

As noted above, the dynamically boosted current source circuit can be used to boost the current at an input node, an output node, a node internal to a responsive circuit, or any combination of these. An example of its use for boosting a circuit's bias currents to improve its ability to drive a capacitive output load is illustrated in FIG. 8. In this application, a circuit 70 receives one or more bias currents which are boosted when an input signal transition is detected; circuit 70 is here referred to as the "boosted circuit". The output of boosted circuit 70 drives a capacitive load $C_{load}$. Circuit 70 is arranged to vary the output to $C_{load}$ in response to a change in the state of an input signal INPUT received at an input node 72. For example, circuit 70 may be a programmable voltage regulator which provides a selectable output voltage, with the output voltage determined by the states of one or more input signals. When one of the input signals changes state, the output voltage must change. The transition of the output voltage from one voltage to another may be slowed because of $C_{load}$ and/or the capacitance associated with one or more nodes internal to circuit 70.

To improve the responsiveness of circuit 70, at least one dynamically boosted current source circuit 36 is employed to provide one or more boosted bias currents to circuit 70 upon detection of a change in the state of INPUT. In this exemplary circuit, a bias current boost is provided for either a low-to-high or a high-to-low transition of INPUT, with the duration of the bias current boost made equal to a predetermined time interval $T_D$.

Figure 9:
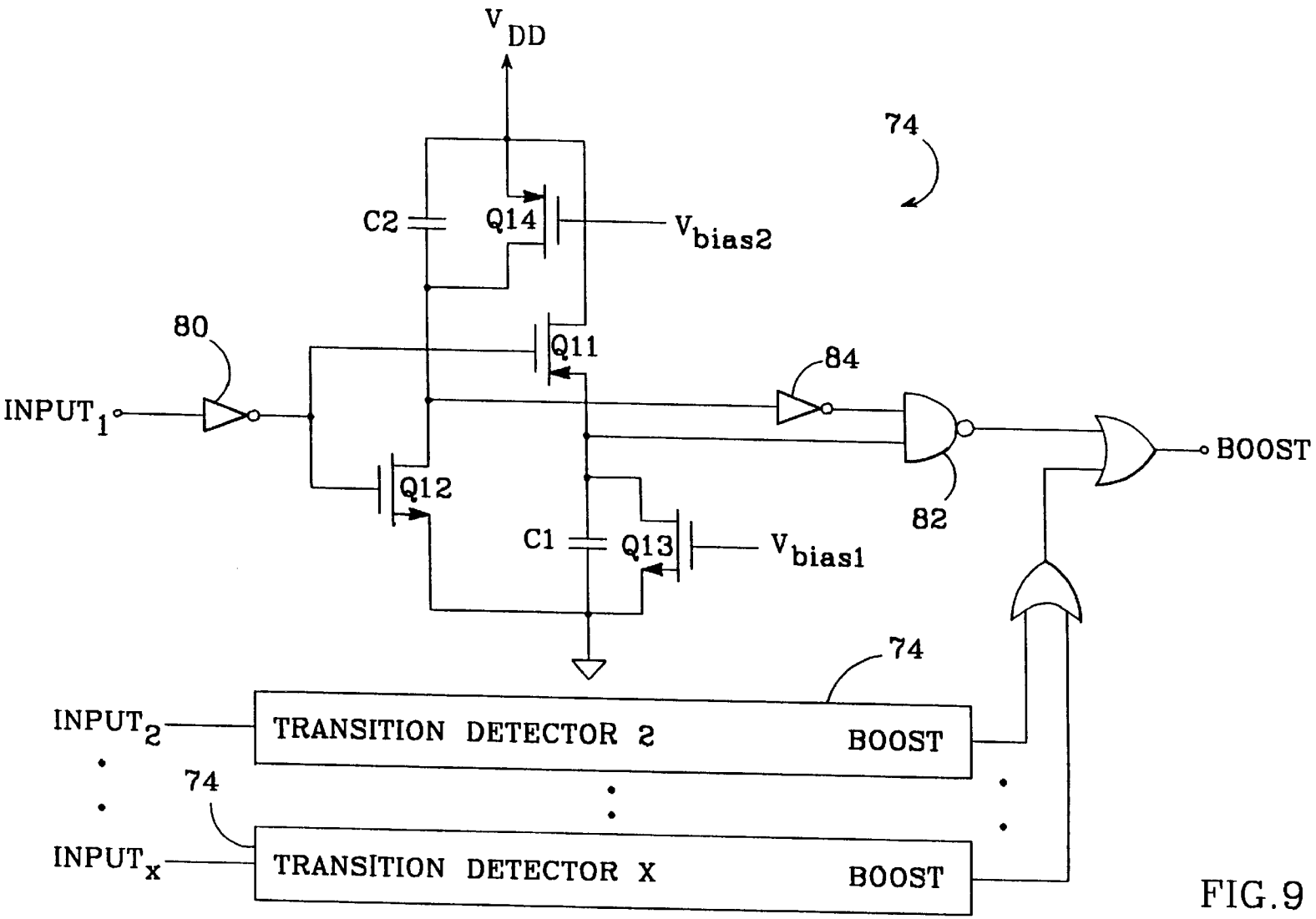
FIG. 9 is a schematic diagram of the transition detector circuit shown in the FIG. 8.

Because a bias current boost occurs for either a rising or falling transition, the detection circuit of circuit 36 is referred to as a transition detector 74. An implementation of transition detector 74 is shown in FIG. 9. An input signal $INPUT_1$ is received by an inverter 80, the output of which is connected to drive a p-channel transistor Q11 and an n-channel transistor Q12. The inverter has an associated input threshold voltage $V_{thdev}$. As INPUT transitions from low-to-high, it crosses $V_{thdev}$ and the inverter output goes low, turning Q11 on and Q12 off. Q11's current circuit is connected between a supply voltage and a capacitor C1, which is quickly charged when Q11 is turned on. A transistor Q13 is connected across C1 and driven by a bias voltage $V_{bias1}$; when Q11 switches off, C1 is discharged at a rate determined by Q13 and $V_{bias1}$. Thus, C1 is charged on a rising edge of INPUT and discharged on a falling edge. The voltage across C1 is fed to one input of a two-input NAND gate 82.

Transistor Q12 is connected between a capacitor C2 and ground; C2 is charged when Q12 is turned on by INPUT transitioning from high-to-low. A transistor Q14 is connected across C2 and driven by a bias voltage $V_{bias2}$; when Q12 switches off, C2 is discharged at a rate determined by Q14 and $V_{bais2}$. Thus, C2 is charged on a falling edge of INPUT and discharged on a rising edge. The voltage across C2 is fed to an inverter 84, and the output of inverter 84 is connected to the second input of NAND gate 82. The output of NAND gate 82 is a signal identified as BOOST.

When INPUT is idle (either high or low), BOOST is low. When INPUT changes state—either low-to-high or high-to-low—a BOOST pulse is produced, due to the time overlap between the charge and discharge of C1 and C2. The width of each BOOST pulse can be adjusted by varying the values of C1 and/or C2, bias voltages $V_{bias1}$ and/or $V_{bias2}$, and/or the relative sizes of transistors Q11—Q14; the BOOST pulse width will affect the amount of time $T_D$ that a boosted current is provided to the boosted circuit 70.

A number of different input signals could be individually monitored to trigger a boost pulse. For example, a programmable voltage regulator as mentioned above could use three input lines to program the regulator to one of eight output voltages. A change from one output voltage to another could be signaled by a change on one or more of the lines, with each voltage change preferably accompanied by a current boost. To monitor a number of input lines in this way, a number of transition detectors equal to the number of input lines are employed. This is illustrated in FIG. 9: transition detectors TRANSITION DETECTOR 2 through TRANSITION DETECTOR X receive additional inputs $INPUT_2$ through $INPUT_x$, respectively. The boost pulses produced by the respective detectors are OR'd together and fed to the current source circuit (described below), so that a change in state on any of the input lines results in a current boost to the boosted circuit 70.

Referring back to FIG. 8, the boost pulse output of transition detector 74 is fed to a current source circuit 90, which has two operating states: a first operating state in which no current or a nominal current is provided to boosted circuit 70, and a second operating state—triggered by receipt of a boost pulse—in which a boosted current greater than the nominal current is provided to the boosted circuit 70.

Figure 10:
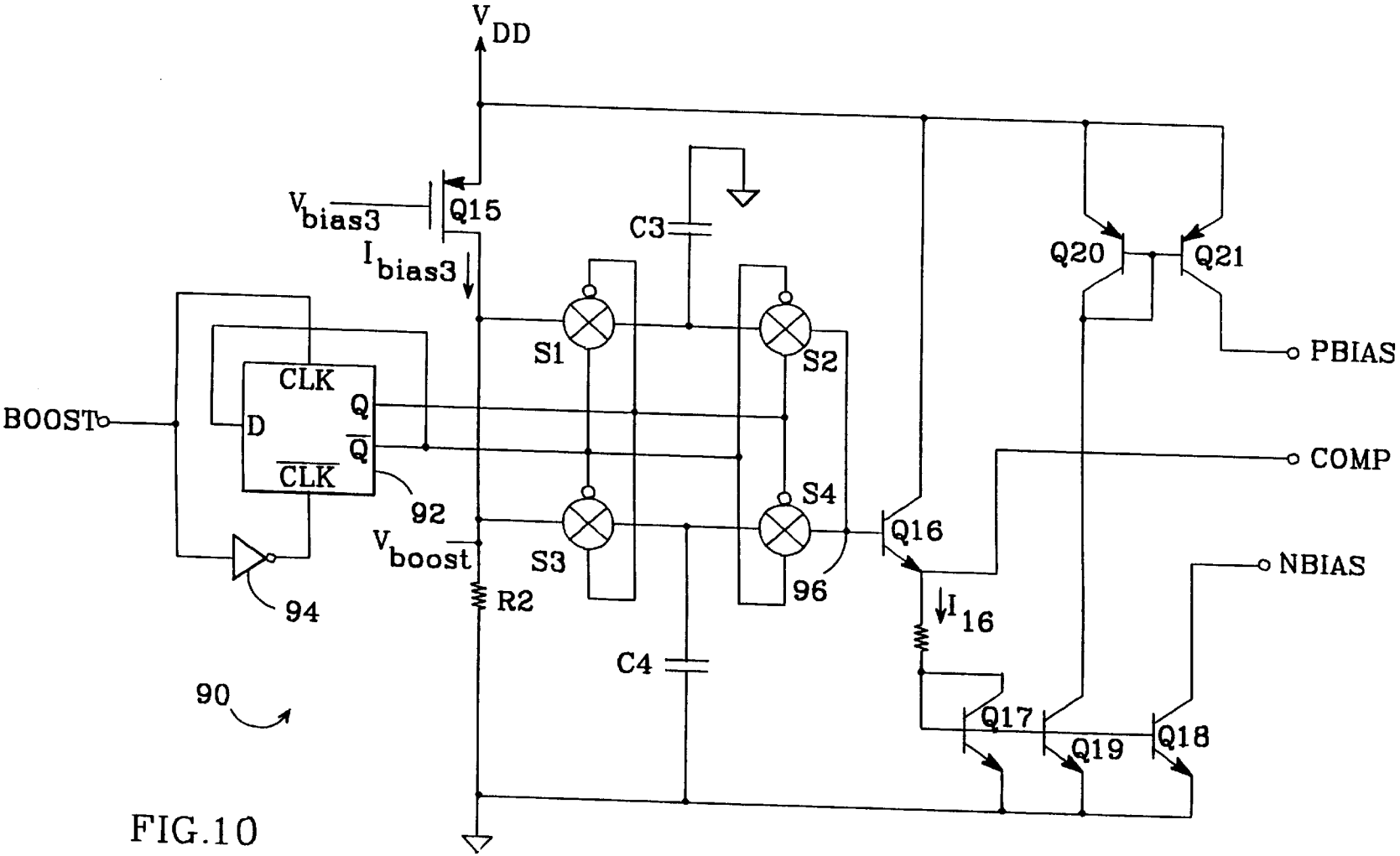
FIG. 10 is a schematic diagram of the current boosting circuit shown in FIG. 8.

One possible implementation of current source 90 is shown in FIG. 10. Boost pulse (or OR'd boost pulses) BOOST is connected to the CLOCK input of a D-type flip-flop 92. BOOST is also connected to a $\overline{CLOCK}$ input on flip-flop 92 via an inverter 94. The flip-flop's $\overline{Q}$ output is connected to the its D input. This arrangement causes the flip-flop to be clocked on the rising edge of the boost pulse, causing the flip-flop's Q and $\overline{Q}$ outputs to toggle.

A transistor Q15 receives a bias voltage $V_{bias3}$ and conducts a current $I_{bias3}$ in response, which is forced through a resistor R2 to produce a bias voltage $V_{boost}$ (=$I_{bias3}$/R2). Current source 90 includes four switches S1–S4, each of which conducts a signal between first and second switch terminals whelp a logic "high" and a logic "low" are present at first and second control terminals, respectively. A capacitor C3 is connected to $V_{boost}$ via switch S1 when S1 is closed, and to a node 96 via S2 when S2 is closed. Another capacitor C4 is connected to $V_{boost}$ via switch S3 when S3 is closed, and to node 96 when S4 is closed.

The control terminals of switches S1–S4 are connected to the Q and $\overline{Q}$ outputs of flip-flop 92. When the flip-flop's outputs toggle, one of capacitors C3 or C4 is charged (via S1 or S3) up to $V_{boost}$, while the other capacitor is discharged (via S2 or S4) to node 96. Node 96 is connected to drive a transistor Q16, which responds by conducting a current $I_{16}$ through a diode-connected transistor Q17. $I_{16}$ is mirrored via a transistor Q18 to produce an output NBIAS from current source 90. $I_{16}$ is also mirrored via a transistor Q19 to another current mirror made up of transistors Q20 and Q21; Q21 produces a second output PBIAS from current source 90.

NBIAS and PBIAS are boost currents, generated only when a BOOST pulse is received in response to a transitioning INPUT signal. The duration $T_D$ of these boost currents is affected by the BOOST pulse width factors cited above, as well as by the size of capacitors C3 and C4 and the voltage $V_{boost}$. The duration of the boost current should be long enough for the desired change of state in the boosted circuit 70 to occur. Furthermore, if several input signals can trigger a boost pulse (as described above), and those input signals toggle nearly simultaneously, the boost current duration should be at least as long as the worst-case skew between the input signals.

Figure 11:
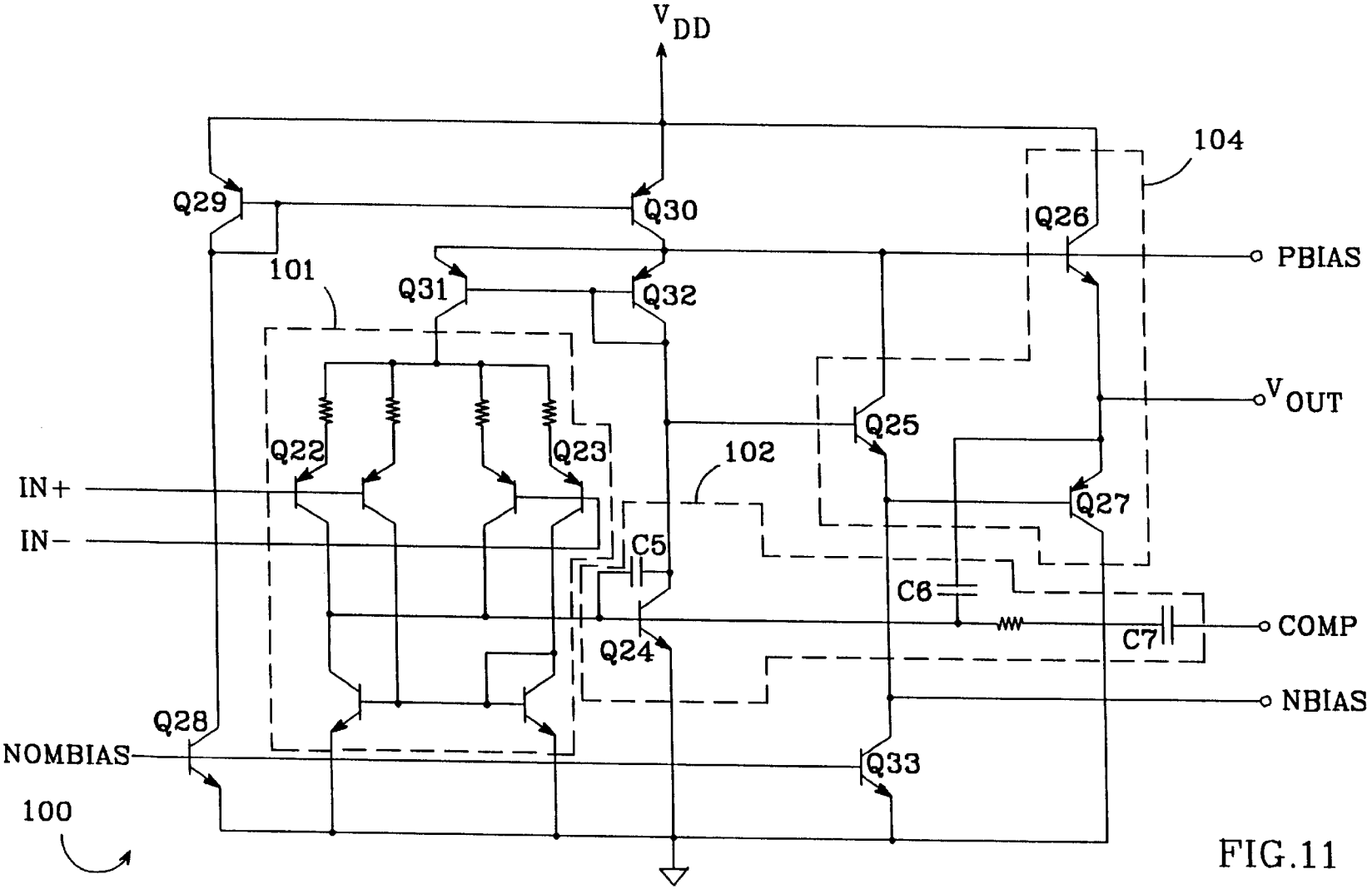
FIG. 11 is a schematic diagram of the boosted circuit shown in FIG. 8.

One example of a boosted circuit 70 is an operational amplifier, such as might be used in the programmable voltage regulator discussed above. An op amp 100 having a response speed which is improved by boost currents NBIAS and PBIAS is shown in FIG. 11. The op amp has a first stage 101 which includes a differential pair Q22 and Q23, a second stage 102 which includes compensation components CS, C6 and C7 and a transistor Q24, and an output stage 104 which includes a transistor Q25 connected between a push-pull pair Q26 and Q27. Nominal bias currents are generated for the stages using a signal NOMBIAS, which is received by a transistor Q28. Q28 conducts a current through a diode-connected transistor Q29, which mirrors the Q28 current to a transistor Q30. Q30 supplies bias current to first stage 101 through a transistor Q31, to second stage 102 through a transistor Q32, and to the amplifier's output $V_{out}$ (and capacitive load $C_{load}$) via output stage transistor Q26. NOMBIAS is also received by a transistor Q33, which also provides bias current to $V_{out}$ via output stage transistor Q27.

The boost currents that appear on PBIAS and NBIAS cause each of the stages' nominal bias currents to be boosted, which increases the speed with which the amplifier's output can change. PBIAS and NBIAS are connected to provide additional base drive currents to transistors Q26 and Q27, respectively, increasing the output stage bias currents. The remaining PBIAS current is split between Q31 and Q32 according to their respective sizes, increasing the bias currents to and improving the responsiveness of the first and second stages, respectively.

When PBIAS is present, additional current is provided to input stage 101 via Q31, and differential pair Q22 and Q23 slew faster and deliver more current to second stage transistor Q24. Q24 also receives additional current via Q32, improving Q32's ability to drive output stage transistor Q25. Q25's current circuit is connected between PBIAS and NBIAS; when boosted, PBIAS increases the amount of available current to Q25, and NBIAS increases the amount of Q25 current that can be sunk, enabling output stage transistors Q26 and Q27 to respond even faster. All of the boosted bias currents contribute to the op amp's ability to quickly charge a capacitive load connected to $V_{out}$ so that $V_{out}$ can quickly increase, or to discharge a capacitive load so that $V_{out}$ can quickly decrease. The duration of the BOOST signal is preferably arranged to keep the bias currents boosted until the op amp's output voltage has settled to a final value.

The op amp 100 of FIG. 11, as well as transition detector 74 of FIG. 9 and the current booster 90 of FIG. 10 are merely illustrative. For example, op amp 100 could be implemented with FET transistors, or in a myriad of alternative configurations, and still provide improved responsiveness in response to the receipt of one or more boosted bias currents when one or more dynamically boosted current source circuits are employed as described herein. The benefits of boosting the current to one or more circuit nodes in response to a transitioning input signal per the present invention could be realized with many different circuit implementations; the invention only requires 1)a circuit which responds to a transitioning input signal and has at least one circuit node which, upon receiving a boosted current, improves the response speed of the circuit, and 2)a means of detecting the transitioning input signal and providing the boosted current in response.

While particular embodiments of the invention have been shown and described, numerous variations and alternate embodiments will occur to those skilled in the art. Accordingly, it is intended that the invention be limited only in terms of the appended claims.

We claim:

1. A dynamically boosted current source circuit, comprising:

an input node, a threshold detector arranged to detect when an input signal connected to said input node crosses a first predetermined threshold, a capacitive node connected such that the speed with which said capacitive node changes state affects the response speed of an associated circuit that is responsive to a transition of said input signal, a boosted node connected such that the current received at said boosted node affects the speed with which said capacitive node changes state, and a current source arranged to provide a first current to said boosted node when said input signal is idle and a boosted current greater than said first current to said boosted node when said threshold detector detects that said input signal has crossed said first predetermined threshold, said current source arranged such that the rate at which its output current is slewed from said first current to said boosted current and the amplitude of said boosted current are independent of the slew rate and amplitude of said input signal, said boosted current increasing the speed with which said capacitive node changes state and there by the speed with which said associated circuit responds to a transition of said input signal.

2. The dynamically boosted current source circuit of claim 1, wherein said boosted node is said input node, said current source arranged such that the rate at which its output current is slewed from said first current to said boosted current and the amplitude of said boosted current are independent of the slew rate and amplitude of said input signal prior to said current boost.

3. The dynamically boosted current source circuit of claim 2, wherein said capacitive node is said input node and said boosted current increases the speed with which said input signal transitions.

4. The dynamically boosted current source circuit of claim 3, wherein said input signal originates from an open drain or open collector of a transistor and said boosted current increases the speed with which said input signal is pulled to a known voltage when said transistor is turned off.

5. The dynamically boosted current source circuit of claim 1, wherein said capacitive node is an internal node of said associated circuit, said boosted current increasing the speed with which said associated circuit responds to a transition of said input signal.

6. The dynamically boosted current source circuit of claim 5, wherein the speed with which said associated circuit responds to a transition of said input signal is limited by the magnitude of a bias current received at said internal node, said internal node receiving a nominal bias current when said input signal is idle, said nominal bias current being boosted by said boosted current when a transition of said input signal is detected, said boosted bias current thereby increasing the speed with which said associated circuit responds to a transition of said input signal.

7. The dynamically boosted current source circuit of claim 1, wherein said capacitive node is driven by an output of said associated circuit, said boosted current increasing the speed with which said circuit's output responds to a transition of said input signal.

8. The dynamically boosted current source circuit of claim 1, wherein said current source is arranged to provide said boosted current for a predetermined time period after said threshold detector detects that said input signal has crossed said first predetermined threshold.

9. The dynamically boosted current source circuit of claim 1, wherein said boosted current increases the speed with which said capacitive node is charged.

10. The dynamically boosted current source circuit of claim 1, wherein said boosted current increases the speed with which said capacitive node is discharged.

11. The dynamically boosted current source circuit of claim 1, further comprising a circuit that is responsive to a transition of said input signal, said capacitive node associated with said responsive circuit such that the speed with which said capacitive node changes state affects the response speed of said responsive circuit.

12. The dynamically boosted current source circuit of claim 1, wherein said associated circuit responds to a transition of said input signal when said input signal crosses a second predetermined threshold equal to or greater than said first predetermined threshold.

13. The dynamically boosted current source circuit of claim 1, wherein said current source is arranged to provide said boosted current until said input signal has crossed a second predetermined threshold voltage.

14. The dynamically boosted current source circuit of claim 13, wherein said threshold detector is a window comparator.

15. A dynamically boosted current source circuit for increasing the speed with which a signal from an open drain or open collector transmitting device is pulled down to a known voltage, comprising:

an input node having an associated capacitance and connected to receive an input signal from an open drain or open collector transmitting device, a threshold detector arranged to detect when said input signal has crossed a first predetermined threshold voltage, and a current source arranged to provide a first current to said input node when said input signal is above said first predetermined threshold voltage and to provide a boosted current greater than said first current to said input node to pull said input signal down to a known voltage when said input signal falls below said first predetermined threshold voltage, said current source arranged such that the rate at which its output current is slewed from said first current to said boosted current and the amplitude of said boosted current are independent of the slew rate and amplitude of said input signal prior to said current boost, said boosted current increasing the speed with which said associated capacitance is discharged and thereby increasing the speed with which said input node is pulled down to said known voltage.

16. A dynamically boosted current source circuit for increasing the speed with which a signal from an open drain or open collector transmitting device is pulled up to a known voltage, comprising:

an input node having an associated capacitance and connected to receive an input signal from an open drain or open collector transmitting device, a threshold detector arranged to detect when said input signal has crossed a first predetermined threshold voltage, and a current source arranged to provide a first current to said input node when said input signal is below said first predetermined threshold voltage and to provide a boosted current greater than said first current to said input node to pull said input signal up to a known voltage when said input signal exceeds said first predetermined threshold voltage, said current source arranged such that the rate at which its output current is slewed from said first current to said boosted current and the amplitude of said boosted current are independent of the slew rate and amplitude of said input signal prior to said current boost, said boosted current increasing the speed with which said associated capacitance is charged and thereby increasing the speed with which said input node is pulled up to said known voltage.

17. The dynamically boosted current source circuit of claim 16, wherein said threshold detector is a voltage comparator which receives said input signal at a first input and said first predetermined threshold voltage at a second input.

18. The dynamically boosted current source circuit of claim 16, further comprising an external circuit which receives said input signal and is arranged to change state when said input signal crosses a second predetermined threshold voltage equal to or greater than said first predetermined threshold voltage, said increased speed with which said associated capacitance is charged increasing the speed of a low-to-high input signal transition and thereby increasing the speed with which said external circuit changes state.

19. The dynamically boosted current source circuit of claim 16, wherein said current source is arranged to provide said boosted current for a predetermined time period after said input signal exceeds said first predetermined threshold voltage.

20. The dynamically boosted current source circuit of claim 16, wherein said current source is arranged to provide said boosted current until said input signal has crossed a second predetermined threshold voltage.

21. The dynamically boosted current source circuit of claim 20, wherein said threshold detector is a window comparator which receives said first predetermined threshold voltage and said second predetermined threshold voltage at respective inputs.

22. The dynamically boosted current source circuit of claim 16, wherein said current source comprises first and second transistors having respective current circuits connected between a supply voltage and said input node, said current source arranged such that said first transistor generates said first current and, when said threshold detector detects that said input signal exceeds said first predetermined threshold voltage, said second transistor generates a second current, said first current and said second current being combined to create said boosted current.

23. The dynamically boosted current source circuit of claim 22, wherein said second transistor is larger than said first transistor such that, for the same control input voltage, said second transistor conducts more current than b said first transistor.

24. The dynamically boosted current source circuit of claim 22, wherein said second transistor comprises two or more transistors connected in parallel which, when said threshold detector detects that said input signal exceeds said first predetermined threshold voltage, conduct respective currents which are combined to gene rate said second current, said two or more transistors sized such that, for the same control input voltage, said two or more transistors conduct a desired integral or fractional multiple of the current conducted by said first transistor.

25. The dynamically boosted current source circuit of claim 22, wherein said first and said second transistors are field-effect transistors (FETs) and said second FET conducts said second current until the voltage at said input node is sufficient to drive said second FET into its triode region.

26. The dynamically boosted current source circuit of claim 22, further comprising a third transistor which conducts a current established by a fixed current source, said first and second transistors connected to mirror said third transistor's current to produce said first and said second currents, respectively.

27. The dynamically boosted current source circuit of claim 26, further comprising a fourth transistor connected to mirror said third transistor's current through a resistor, the voltage across said resistor providing said first predetermined threshold voltage.

28. A dynamically boosted current source circuit for increasing the response speed of a circuit responsive to a transitioning input signal, comprising:

an input node which receives an input signal, an external circuit which is responsive to a transition of said input signal and which includes at least one capacitive node distinct from said input node, the speed with which said capacitive node changes state affecting the speed with which said external circuit responds to a transition of said input signal, a transition detector arranged to detect a transition of said input signal connected to said input node, and a current source arranged to provide at least one boost current when a transition of said input signal is detected, said boost current connected to boost the current provided to said at least one capacitive node to increase the speed with which said at least one capacitive node changes state and thereby the speed with which said external circuit responds to said input signal transition, said current source arranged such that said at least one boost current's slew rate and amplitude are independent of the slew rate and amplitude of said input signal.

29. The dynamically boosted current source circuit of claim 28, wherein said at least one boost current increases the current available to discharge said at least one capacitive node, thereby increasing the speed with which said at least one capacitive node changes from a high state to a low state.

30. The dynamically boosted current source circuit of claim 28, wherein said dynamically boosted current source circuit comprises a plurality of said input nodes receiving respective input signals and said transition detector detects a transition by any of said input signals, said current source providing said at least one boost current when a transition by any of said input signals is detected.

31. The dynamically boosted current source circuit of claim 30, wherein said current source is arranged to provide said boost current for a predetermined time period after a transition by any of said input signals is detected, said predetermined time period being at least as long as the worst case skew between said input signals.

32. The dynamically boosted current source circuit of claim 28, wherein said at least one capacitive node is an internal node of an operational amplifier and the speed with which said amplifier responds to a transition of said input signal is limited by the magnitude of a bias current received at said internal node, said internal node connected to receive a nominal bias current when said input signal is idle, said nominal bias current being boosted by said at least one boost current when a transition of said input signal is detected, said boosted bias current thereby increasing the speed with which said amplifier responds to a transition of said input signal.

33. The dynamically boosted current source circuit of claim 32, wherein said operational amplifier has first, second and output stages, each of which includes at least one of said internal nodes which receives a respective nominal bias current when said input signal is idle, each of said nominal bias currents being boosted by said at least one boost current when a transition of said input signal is detected, said boosted bias currents thereby increasing the speed with which said amplifier responds to a transition of said input signal.

34. The dynamically boosted current source circuit of claim 33, wherein said current source provides at least two boost currents, each of said boost currents boosting different ones of said nominal bias currents.

35. The dynamically boosted current source circuit of claim 28, wherein said external circuit is a programmable voltage regulator, the output voltage of said programmable voltage regulator selected in accordance with the state of said input signal.

36. The dynamically boosted current source circuit of claim 35, wherein said dynamically boosted current source circuit comprises a plurality of said input nodes receiving respective input signals, the output voltage of said programmable voltage regulator selected in accordance with the states of said input signals, said current source providing said at least one boost current to said at least one capacitive node when a transition by any of said input signals is detected, thereby increasing the speed with which the output voltage of said programmable voltage regulator can be changed.

37. The dynamically boosted current source circuit of claim 28, wherein said current source is arranged to provide said at least one boost current for either a low-to-high or a high-to-low transition of said input signal.

38. The dynamically boosted current source circuit of claim 28, wherein said at least one boost current increases the current available to charge said at least one capacitive node, thereby increasing the speed with which said at least one capacitive node changes from a low state to a high state.

39. A method of improving the response speed of a circuit which has at least one capacitive node and is responsive to a transitioning input signal, comprising the steps of:

providing a first current to at least one capacitive node in a circuit responsive to a transitioning input signal, the speed with which said capacitive node changes state affecting the speed with which said circuit responds to an input signal transition, detecting when said input signal is transitioning, boosting the current to said at least one capacitive node when an input signal transition is detected to increase the speed with which said capacitive node changes state, said current to said at least one capacitive node boosted at a predetermined rate and to a predetermined amplitude, said predetermined rate and predetermined amplitude independent of the slew rate and amplitude of said input signal.

40. The method of claim 39, wherein said capacitive node is an internal node of an operational amplifier, the speed with which said amplifier responds to a transition of said input signal being limited by the magnitude of a bias current received at said internal node, said step of boosting the current to said capacitive node increasing the bias current to said internal node and thereby increasing the speed with which said amplifier responds to a transition of said input signal.

41. The method of claim 39, wherein said input signal is received at an input node and said at least one capacitive node is said input node.

42. The method of claim 41, wherein said input signal originates from an open drain or open collector transistor, said boosted current increasing the speed with which said input node is pulled to a known voltage when said transistor turns off.

43. The method of claim 39, wherein said input signal is received at an input node and said at least one capacitive node is distinct from said input node.

44. The method of claim 39, wherein said capacitive node is an output node of said circuit, said boosted current increasing the speed with which said output node changes state in response to a transitioning input signal.

* * * * *